US005900264A

United States Patent [19]

Gics

[11] Patent Number: 5,900,264

[45] Date of Patent: May 4, 1999

[54] FOOD PACKAGE INCLUDING A TRAY AND A SLEEVE SURROUNDING THE TRAY

[75] Inventor: Paul W. Gics, Sewickley Heights, Pa.

[73] Assignee: Gics & Vermee, L.P., Sewickley, Pa.

[21] Appl. No.: 08/965,578

[22] Filed: Nov. 6, 1997

[51] Int. Cl.[6] ..... B65D 85/00

[52] U.S. Cl. ..... 426/107; 426/113; 426/124; 426/122; 206/557; 206/45.25; 229/906; 229/104; 229/903

[58] Field of Search ..... 426/124, 106, 426/113, 378, 107, 87, 122; 220/631, 635, 628; 206/461, 45.25, 462, 562, 779, 563, 784, 557, 769; 229/903, 103, 242, 906

[56] References Cited

U.S. PATENT DOCUMENTS

| | | | |
|---|---|---|---|
| 3,126,660 | 3/1964 | Meyers . | |
| 3,183,100 | 5/1965 | Bonini . | |
| 3,281,051 | 10/1966 | O'Brien et al. . | |
| 3,349,985 | 10/1967 | Salway . | |
| 3,580,466 | 5/1971 | Thelen et al. . | |
| 3,759,378 | 9/1973 | Werth . | |
| 4,013,798 | 3/1977 | Goltsos . | |
| 4,065,583 | 12/1977 | Ahlgren . | |
| 4,221,320 | 9/1980 | Faller . | |
| 4,496,815 | 1/1985 | Jorgensen . | |
| 4,671,453 | 6/1987 | Cassidy . | |
| 4,701,585 | 10/1987 | Stewart . | |
| 4,787,509 | 11/1988 | Pasternicki . | |
| 4,794,005 | 12/1988 | Swiontek . | |
| 4,821,884 | 4/1989 | Griffin et al. . | |
| 4,831,224 | 5/1989 | Keefer . | |
| 4,870,233 | 9/1989 | McDonald et al. . | |
| 5,011,006 | 4/1991 | Anderson | 206/45.24 |
| 5,039,833 | 8/1991 | Woods . | |
| 5,060,800 | 10/1991 | Bodet et al. . | |
| 5,110,038 | 5/1992 | Pantisano et al. | 229/906 |
| 5,119,940 | 6/1992 | Grindrod . | |
| 5,123,527 | 6/1992 | Hustad . | |
| 5,217,765 | 6/1993 | Parks . | |
| 5,231,268 | 7/1993 | Hall et al. . | |
| 5,247,149 | 9/1993 | Peleg | 219/10.55 |
| 5,263,633 | 11/1993 | Bicksler, III et al. . | |
| 5,352,465 | 10/1994 | Gondek et al. . | |
| 5,484,984 | 1/1996 | Gics . | |
| 5,492,703 | 2/1996 | Gics . | |
| 5,565,228 | 10/1996 | Gics . | |
| 5,657,873 | 8/1997 | Hustad et al. . | |

*Primary Examiner*—David Lacey
*Assistant Examiner*—Hao Mai
*Attorney, Agent, or Firm*—David V. Radack; Eckert Seamans Cherin & Mellott, LLC

[57] ABSTRACT

A food package including a tray and a sleeve surrounding the tray. The tray includes a base defining an opening and a sidewall extending from the base which terminates in a free edge. The free edge defines a tray opening. The sleeve includes a top panel positioned adjacent the tray opening, a bottom panel positioned adjacent to the opening in the base and a side panel positioned adjacent to at least a portion of the sidewall.

15 Claims, 9 Drawing Sheets

FOOD PACKAGE INCLUDING A TRAY AND A SLEEVE SURROUNDING THE TRAY

BACKGROUND OF THE INVENTION

This invention relates to a food package including a tray and a sleeve surrounding the tray.

Packaged foods, such as frozen pizzas, are sold extensively throughout the United States and the world. These packaged foods offer the consumer a convenient and a sometimes inexpensive alternative to preparing foods from "scratch". Increasingly, packaged foods are becoming microwavable. Many times, however, the food product must be removed from the food package and placed in a separate receptacle for heating in the microwave.

In order to avoid this extra step, ovenable food packages have been developed. For example, it is known to provide a package consisting of a box which contains a frozen pizza. In use, the box is opened and placed in the microwave oven along with the pizza and then subjected to microwave energy.

There are several problems with current ovenable food packages. For microwavable food packages, if the package rests on the microwave oven floor, a heat sink is created which leads to non-uniform heating of the food product. This non-uniform heating causes "cold spots" in the food product. In addition, paperboard materials which are used for the food packages tend to lose their stiffness and rigidity upon heating. This is because the paperboard has a moisture content which is vaporized by the microwave heating. Because of this loss of stiffness, more "heat sinking" can occur and in addition, after removing the package from the microwave oven, the food product is not well supported by the package, thus making it harder to carry the food product in the package.

My U.S. Pat. No. 5,565,228, the disclosure of which is hereby incorporated by reference herein, discloses a food product tray including a base defining an opening. A floor member having a portion secured to the base substantially directly supports the food product in the tray. The floor member, preferably, includes a microwave susceptor material.

While my tray meets many of the needs lacking in prior art trays, there is still a need for an economical, easy to use food package that can efficiently and effectively be used to heat a food product.

SUMMARY OF THE INVENTION

The food package of the present invention has met or exceeded the above-mentioned needs. The food package of the invention comprises a tray including a base defining an opening and a sidewall extending from the base which terminates in a free edge. The free edge defines a tray opening. The food package further comprises a sleeve surrounding the tray. The sleeve includes a top panel positioned adjacent the tray opening, a bottom panel positioned adjacent to the opening in the base and a side panel positioned adjacent to at least a portion of the sidewall.

BRIEF DESCRIPTION OF THE DRAWINGS

A full understanding of the invention can be gained from the following detailed description of the invention when read in conjunction with the accompanying drawings in which.

DETAILED DESCRIPTION

Figure 9:
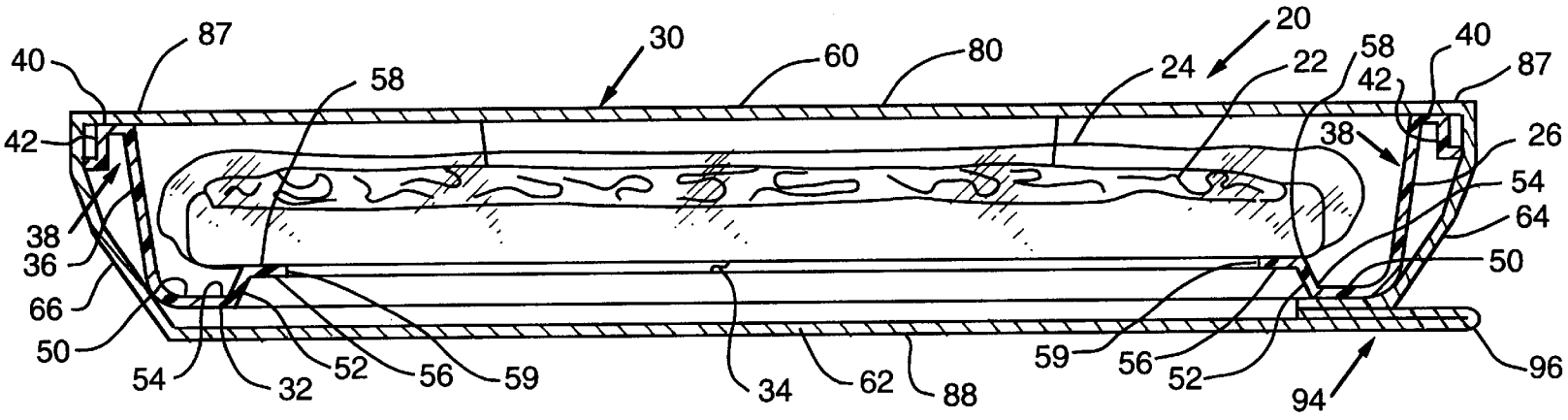
FIG. 9 is a cross-sectional view along line 9—9 of FIG. 3.

Referring to FIGS. 1–9, the food product package 20 of the invention is shown. The food product package 20 is designed to contain a food product, such as a frozen pizza 22 wrapped in a plastic bag 24, therein. The food product package 20 generally consists of a food product tray 26 and a sleeve 30. The food product tray 26 has a base 32 defining a large opening 34. A sidewall 36 extends generally vertically from the periphery of the base 32 and terminates in a stepped flange portion 38 which includes a first horizontal portion 40 that extends generally perpendicularly outward from the sidewall 36 and a second vertical portion 42 that extends generally perpendicularly downwardly from the first horizontal portion 40. The sidewall 36 defines a tray opening 44. Referring particularly to FIG. 9, the base 32 consists of an outer periphery portion 50, an angularly disposed sidewall 52 extending upwardly from the edge 54 of the periphery portion 50 and a flange portion 56 extending from the top edge 58 of the angularly disposed sidewall 52. The flange portion 56 terminates in a free edge 59 that defines the large opening 34 in the base 32.

The food package tray 26 is preferably made of a plastic material. The plastic material can be polyesters, crystallized polyethylene terephlalate ("C-PETE"), polypropylenes or any other plastic material.

The sleeve 30 preferably surrounds the food product tray 26 and consists of (i) a top panel 60 which, when the package 20 is assembled, is positioned adjacent the tray opening 44; (ii) a bottom panel 62 positioned adjacent to the larger opening 34 and the base 32; and (iii) at least one side panel, with two side panels 64 and 66 being shown in FIGS. 1–9. The side panels 64 and 66 are positioned adjacent to at least a portion of the sidewall 36. It will be appreciated that the side panels 64 and 66 join the top panel 60 to the bottom panel 62 in order to create the sleeve 30, so the side panel could be a single, monolithic structure as opposed to the separated and spaced side panels 64 and 66 shown in FIGS. 1–9. The side panels 64 and 66 include scored removing tabs 68 and 70 for use in separating the bottom panel 62 from the top panel 60. The removal process will be discussed further hereinbelow with reference to FIGS. 10–15.

The top panel 60 includes an outer surface 80 on which is printed indicia, such as the word "PIZZA" 82 or other eye-catching graphics. The top panel 60 also includes a score line 84 for use in removing the top panel 60 from the package 20. It is also preferred to provide a finger tab defined by a score line 86. In use, a consumer breaks the score line 86 and places a finger underneath the top panel 60 and pulls the area in which score line 86 is disposed. Score line 84 then facilitates complete removal of the remainder of the top panel 60. It will be appreciated that an edge portion 87 of the top panel is secured to the horizontal portion 40 of the stepped flange portion 38 of the sidewall 36, as is shown in FIG. 9. This can be accomplished by any desired means, such as by using a hot melt adhesive. Alternatively, no adhesives can be used, with the sleeve 40 being merely friction fit over the tray 26 in order to form the package 20. In that event, no score lines 84, 86 are needed for the top panel 60.

Figure 1:
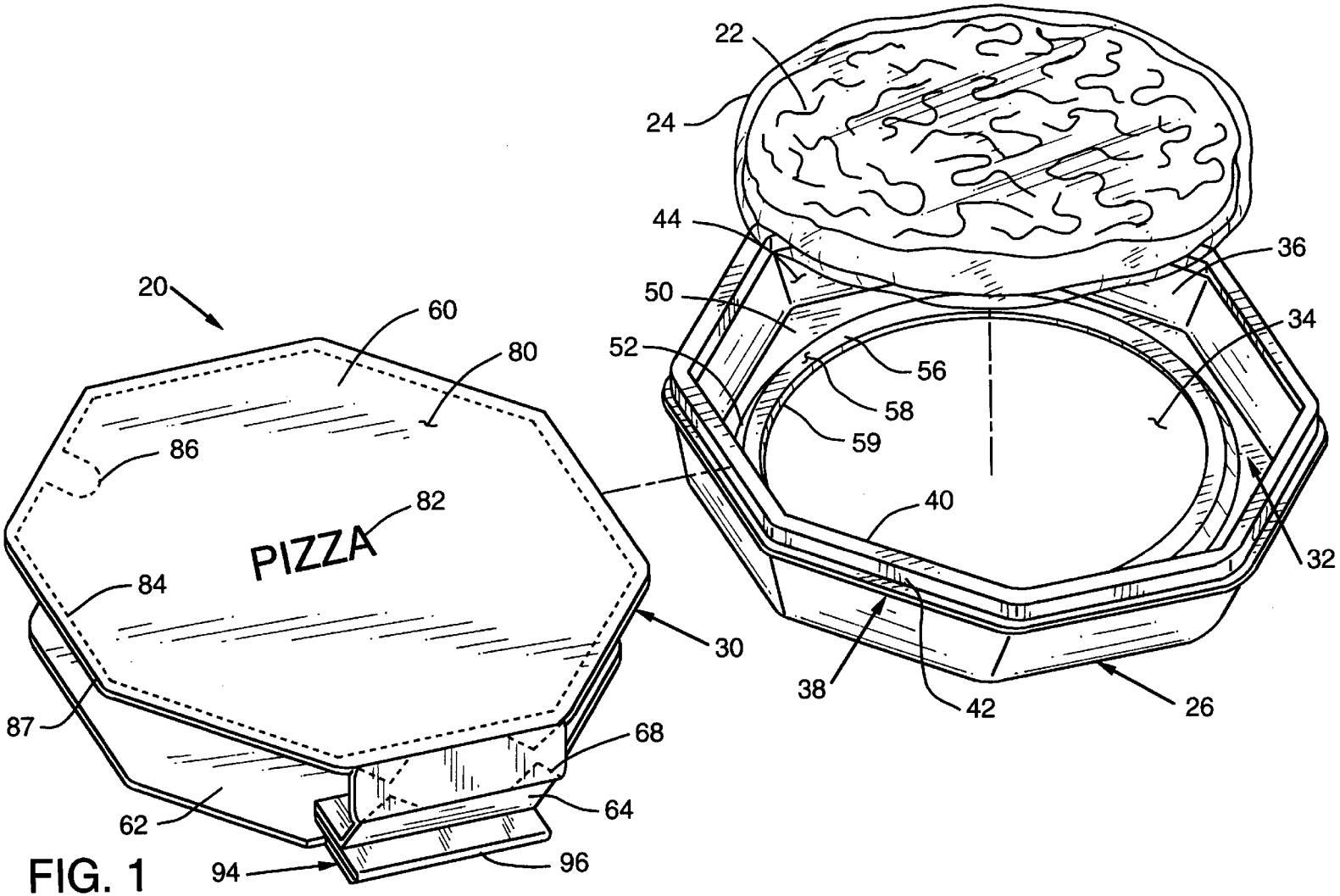
FIG. 1 is an exploded perspective view of the food package of the invention.
Figure 3:
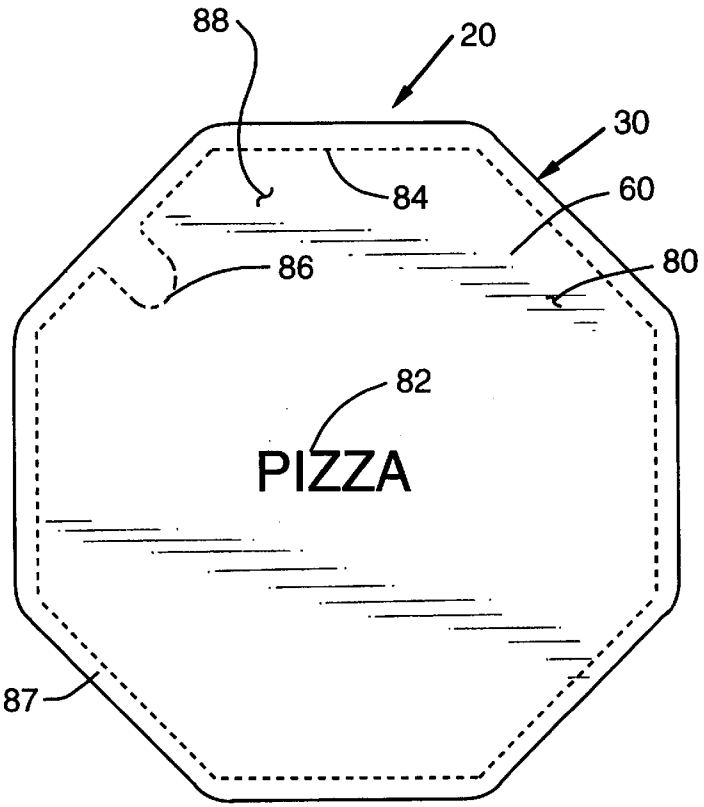
FIG. 3 is a top plan view of the food package of FIG. 2.
Figure 2:
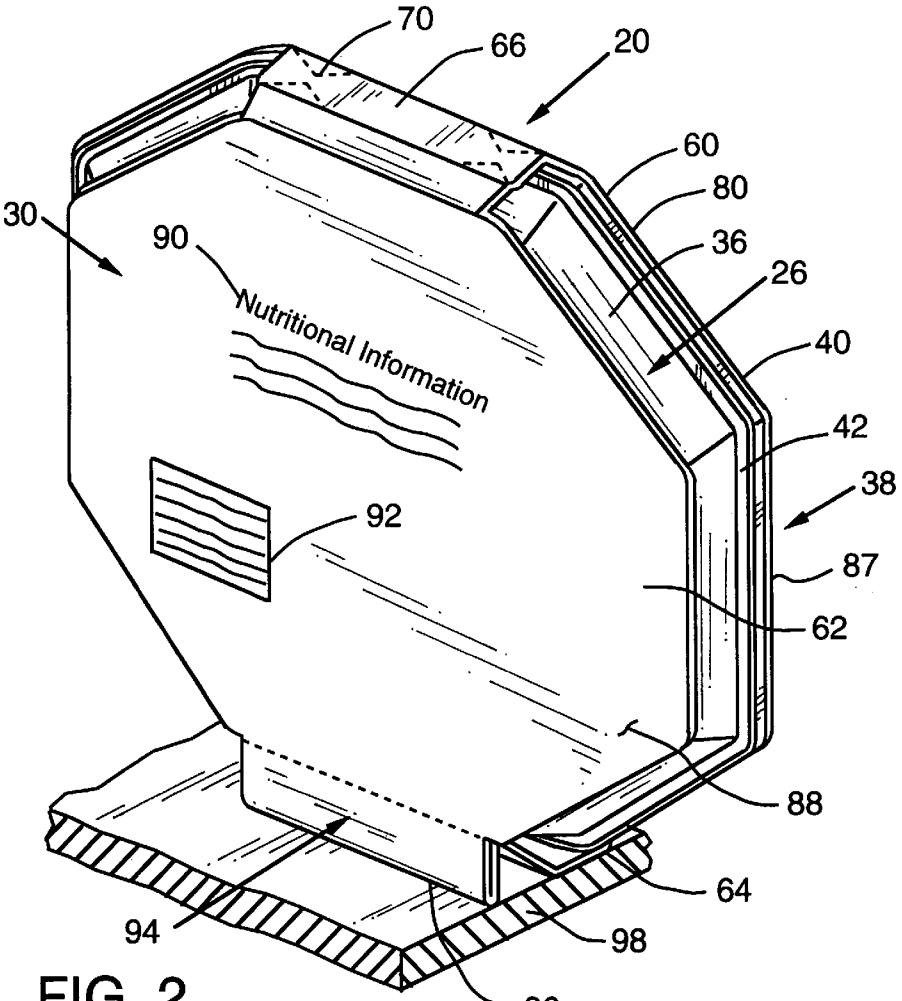
FIG. 2 is a perspective view of the food package as assembled as shown "stood up" on a support surface.
Figure 4:
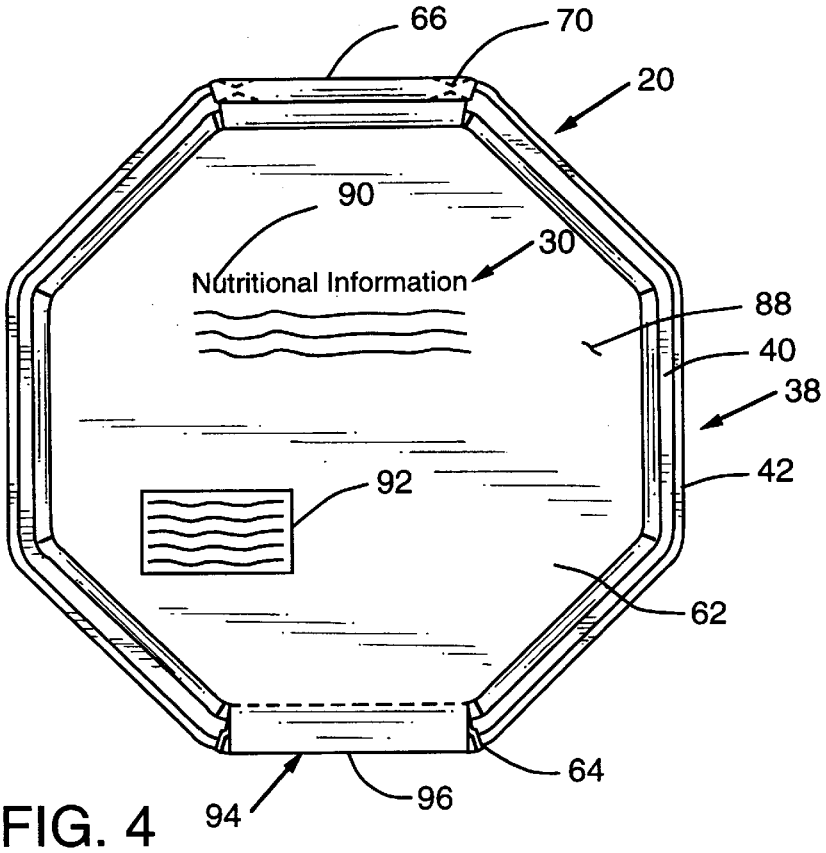
FIG. 4 is a bottom plan view of the food package of FIG. 2.
Figure 5:
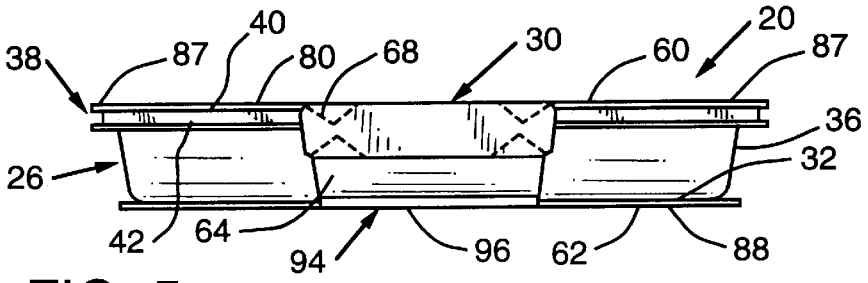
FIG. 5 is a front elevational view of the food package of FIG. 2.
Figure 6:
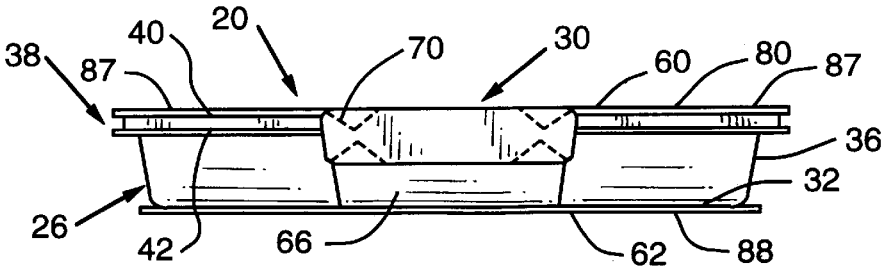
FIG. 6 is a back elevational view of the food package of FIG. 2.
Figure 7:
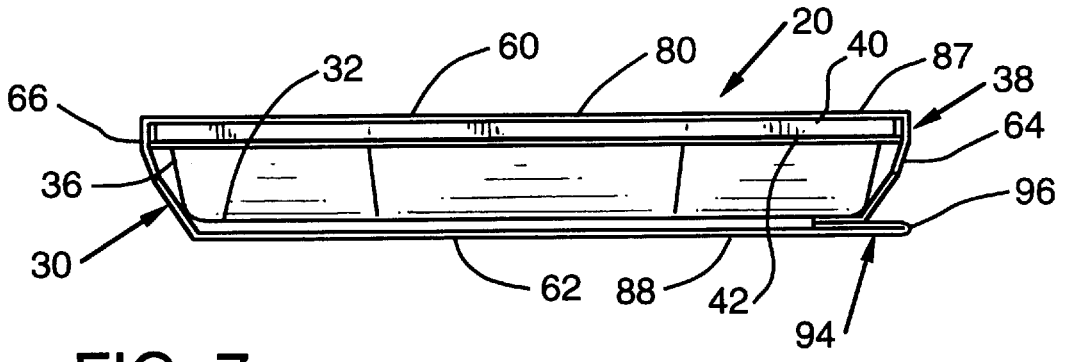
FIG. 7 is a left side elevational view of the food package of FIG. 2.
Figure 8:
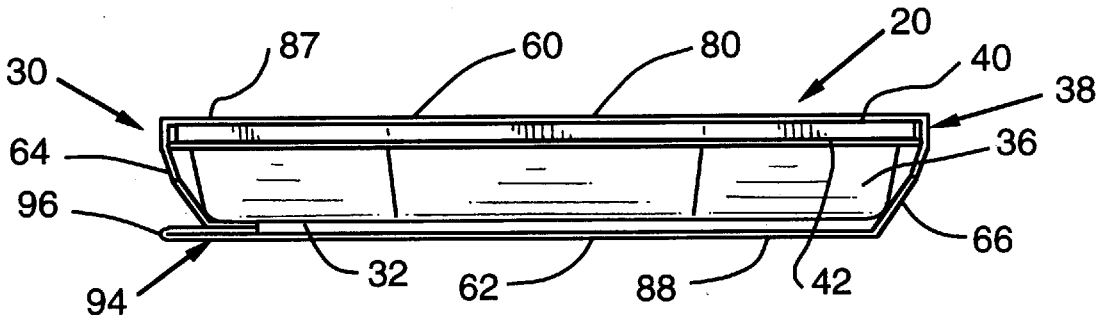
FIG. 8 is a right side elevational view of the food package of FIG. 2.

As can be seen in FIG. 4, the bottom panel 62 includes an outer surface 88 having printed thereon required nutritional information 90 and a bar code 92. One of the advantages of the food product package 20 is that the top panel can be used for eye-catching graphics without the need to print thereon the required packaging information, which, in accordance with the invention, can be printed on the bottom panel 62 as discussed above. This will help to better "sell" the package and the product to the consumer.

Another aspect of the invention is shown in FIGS. 1–9. The bottom panel 62 includes a rigid leg member 94 extending therefrom. The rigid leg member includes a lower edge 96 that is adapted to rest on a grocer's shelf 98 (see FIG. 2) or the like in order to position the top panel 60 substantially perpendicularly to the shelf 94. In this way, the eye-catching graphics on the top panel 60 will be fully and directly exposed to the consumer, thus helping to "sell" the package and the food product contained therein. For further details on the rigid leg member, reference is made to commonly owned U.S. patent application Ser. No. 08/883,062, filed Jun. 26, 1997.

Figure 10:
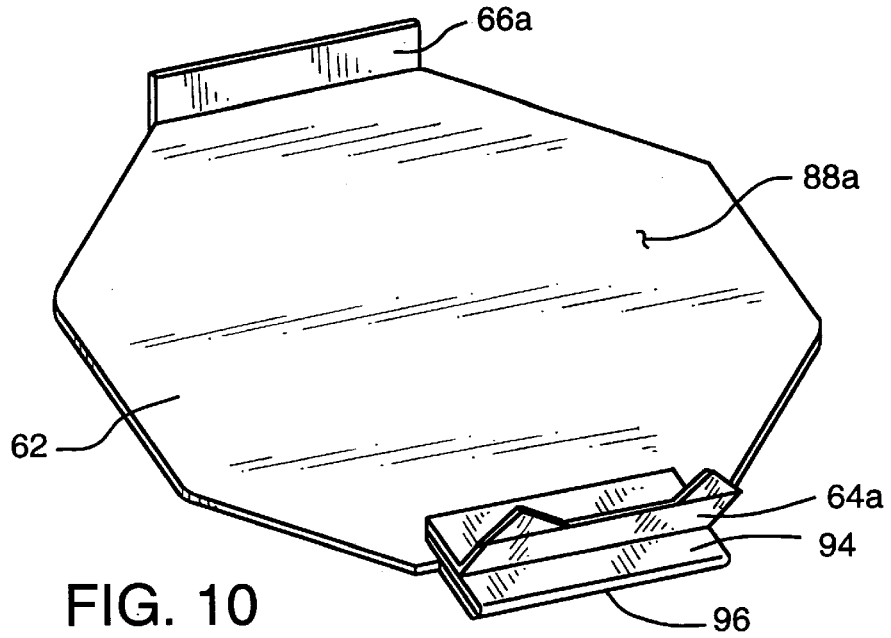
FIG. 10 is a perspective view showing the bottom panel immediately after being detached from the remainder of the sleeve.

Referring now to FIGS. 10–15, the method of using the food package 20 will be discussed. First, the bottom panel 62 is removed from the top panel 60 by stripping the scoring tabs 68 and 70 of side panels 64 and 66 thus causing the bottom panel 62 and a portion of the side panels 64*a* and 66*a* to be detached from the food package 20 as is shown in FIG. 10. As is also shown in FIG. 10, the rigid leg member 94 and the remaining portions of the side panels 64*a* and 66*a* are detached (by means of a weakened slit or score lines, not shown) from the bottom panel 62 leaving the bottom panel 62 in the condition shown in FIG. 11.

Figure 11:
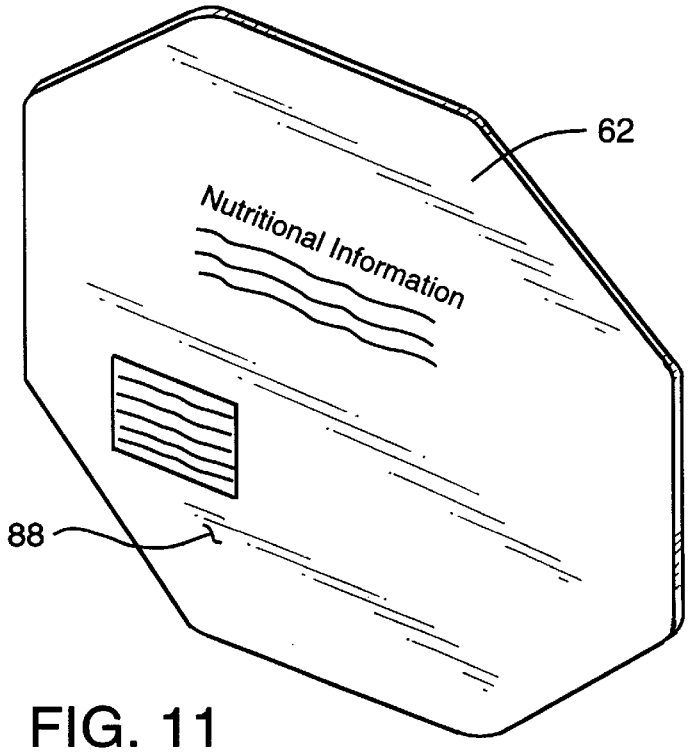
FIG. 11 is a perspective view of the bottom panel after (1) the rigid leg member and (ii) the portions of the side panels have been removed making the bottom panel ready to place in the tray.
Figure 12:
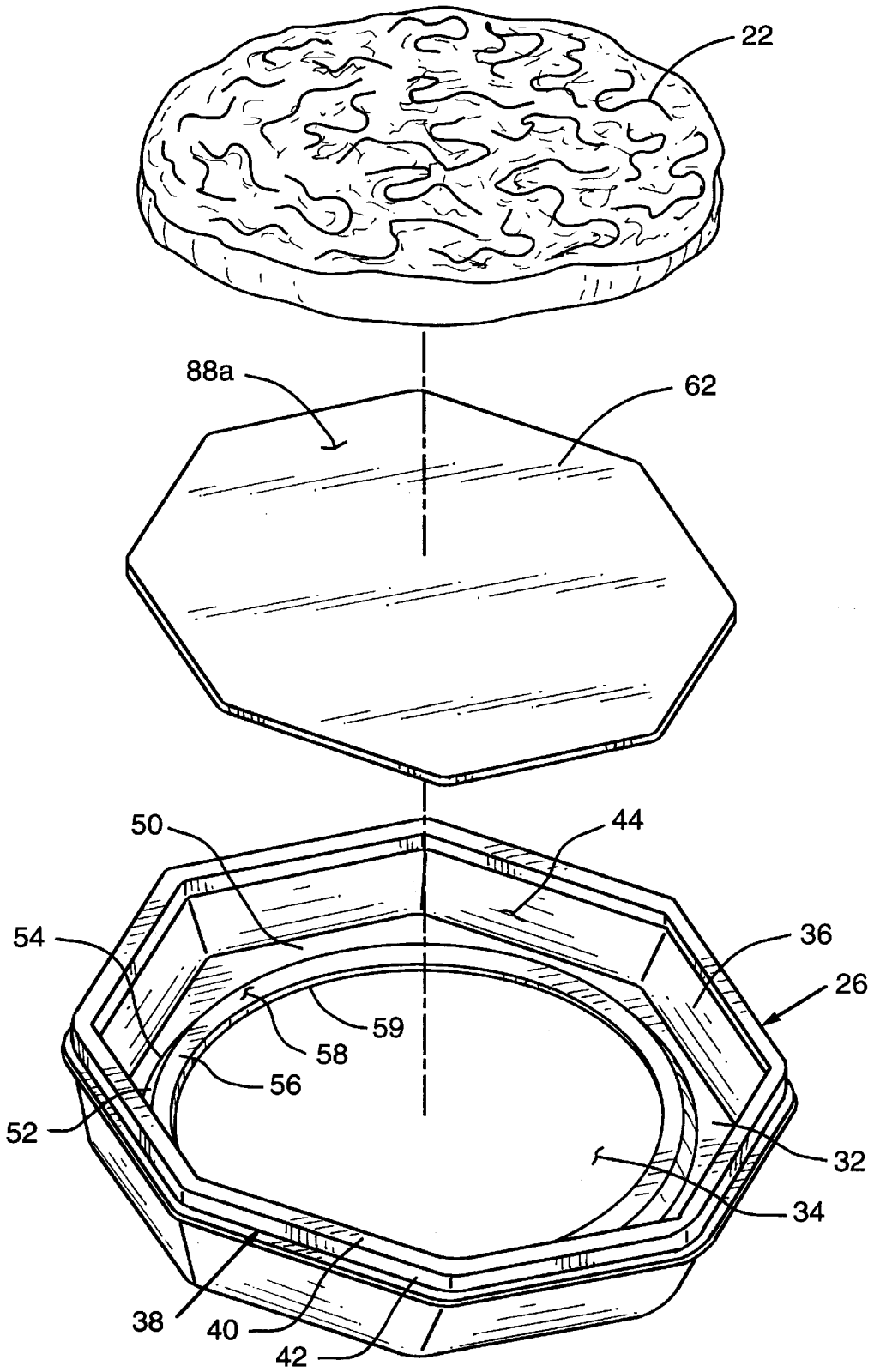
FIG. 12 is an exploded perspective view showing how the bottom panel and unwrapped pizza are placed in the tray.
Figure 13:
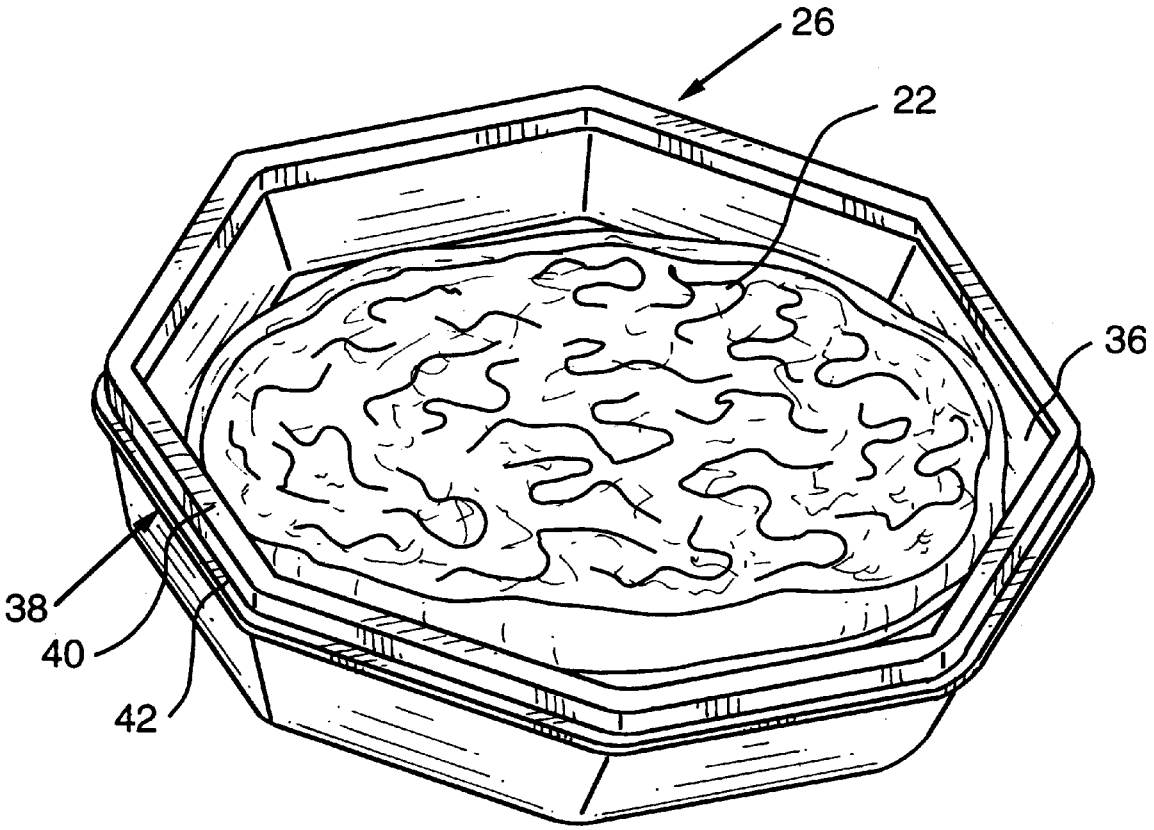
FIG. 13 is a perspective view showing the tray with the bottom panel and pizza therein.

Then, assuming that top panel 60 is adhesively bonded to the tray 26, the top panel 60 is removed by using the score lines 84, 86 and is discarded. After this, the plastic bag 24 (not shown in FIGS. 10–15) containing the pizza 22 is removed from the tray 26, leaving the tray 26 as is shown in FIG. 12. The bottom panel 62, as shown in FIG. 11, is then placed on the flange 56 of the base 30 of the tray 26, with the major side 88*a* of the bottom panel 62 not having indicia facing upwardly. The unwrapped pizza 22 is then placed on the bottom panel 62, and as shown in FIG. 13, the entire assembly is then placed into a microwave oven (not shown) having a support surface 110 (see FIG. 14).

Figure 14:
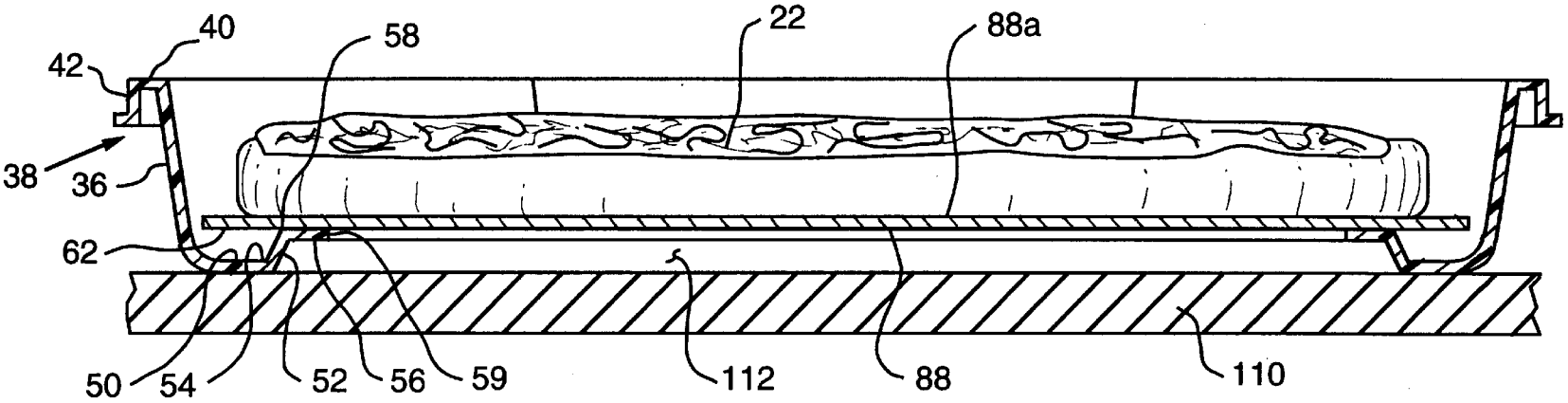
FIG. 14 is a cross-sectional view of the tray, bottom panel and pizza as is supported on a support surface of a microwave oven.

As can be seen in FIG. 14, due to the design of the tray 26, a space 112 is created between the support surface 110 and the base 30 of the tray 26. This will prevent "heat sinking" and also melting of the print used to create the indicia on surface 88 of the bottom panel 62. Other benefits of this design are discussed in U.S. Pat. No. 5,565,228, which is incorporated by reference herein.

Figure 15:
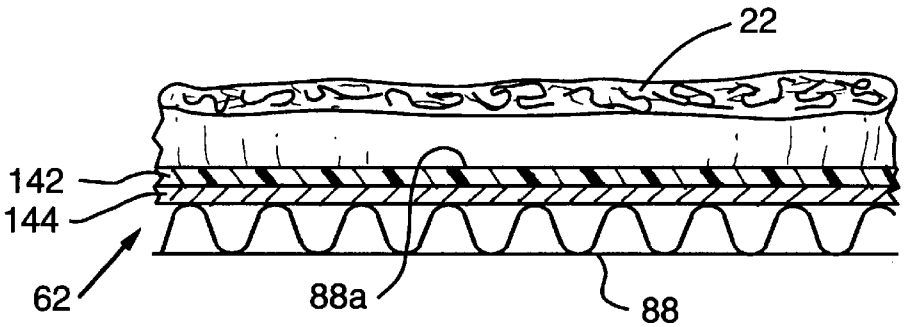
FIG. 15 is a detailed cross-sectional view showing the construction of the bottom panel.

FIG. 15 shows a preferred embodiment for the bottom panel 62. The bottom panel 62 is composed of a paperboard material 140 having a polyester coating 142. Sandwiched between the paperboard material 140 and the polyester coating 142 is a microwave susceptor material 144, such as aluminum.

It will be appreciated that the invention provides an attractive, easy-to-use food package.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A package for a food product for heating the food product in a food heating apparatus having a support surface, said package comprising:

a tray including a base having an opening and a sidewall extending from said base which terminates in a free edge, said free edge defining a tray opening; and a sleeve surrounding said tray, said sleeve including a top panel positioned so as to cover said tray opening, a bottom panel positioned so that it overlies said opening in said base, said bottom panel includes a microwave susceptor material and is removably attached to said sleeve and is sized such that it can be placed in said tray such that said bottom panel overlies said opening in said base so as to be able to support the food product in said tray, and a side panel positioned adjacent to at least a portion of said sidewall.

2. The package of claim 1, wherein said bottom panel has a paperboard layer and a plastic coated layer with a microwave susceptor material sandwiched between said paperboard layer and said plastic coated layer.

3. The package of claim 1, wherein an outer major surface of said paperboard layer has indicia thereon.

4. The package of claim 1, wherein said bottom panel includes a rigid leg member extending therefrom, said rigid leg member having a bottom edge that can rest on a shelf in order to position said top panel substantially perpendicularly to the shelf, whereby said top panel can be better seen by potential consumers.

5. The package of claim 4, wherein said rigid leg member is detachable from said bottom panel.

6. The package of claim 1, wherein said base has at least one downwardly depending leg member with a portion thereof to contact the support surface of the heating apparatus, said leg member cooperating with said bottom panel so that it will create a space between said bottom panel and the support surface of the food heating apparatus.

7. The package of claim 1, wherein said base includes a flange having a free edge which defines said opening; and said bottom panel rests on said flange when said bottom panel is placed in said tray.

8. The package of claim 1, wherein said top panel is secured to said free edge of said sidewall.

9. The package of claim 8, wherein said top panel is adhesively bonded to said free edge of said sidewall.

10. The package of claim 1, wherein said top panel is scored to facilitate removal of said top panel from said package.

11. The package of claim 1, wherein said scoring defines a finger tab to facilitate removal of said top panel.

12. The package of claim 1, wherein said base is made of plastic.

13. The package of claim 12, wherein said plastic is crystallized polyethylene terephlalate.

14. The package of claim 1, further including a food product which is wrapped in a plastic wrap, said plastic wrap being removed when it is desired to heat said food product.

15. The package of claim 14, wherein said food product is a pizza.

* * * * *